United States Patent [19]

Koch

[11] 4,028,655

[45] June 7, 1977

[54] ELECTRICAL CURRENT LIMITING FUSE WITH BOUND SAND FILLER AND IMPROVED LOW CURRENT FAULT CLEARING

[75] Inventor: Robert E. Koch, Pittsfield, Mass.

[73] Assignee: General Electric Company

[22] Filed: Oct. 9, 1975

[21] Appl. No.: 621,060

[52] U.S. Cl. ..... 337/160; 337/295

[51] Int. Cl.[2] ..... H01H 85/10

[58] Field of Search ..... 337/160, 296, 276, 295

[56] References Cited

UNITED STATES PATENTS

| | | | |
|---|---|---|---|
| 2,827,532 | 3/1958 | Kozacka | 337/160 |
| 3,243,552 | 3/1966 | Mikulecky | 337/160 |
| 3,671,909 | 6/1972 | Kozacka et al. | 337/160 |
| 3,838,375 | 9/1974 | Frind et al. | 337/276 |

*Primary Examiner*—Harold Broome
*Attorney, Agent, or Firm*—Francis X. Doyle

[57] ABSTRACT

A high voltage current limiting fuse of the type including a bound silica sand filler has a fusible element provided with evenly spaced perforations along its major length. In the region of the center of the fuse, a segment of the element is provided with additional perforations. At least one of the perforations in the segment has a lead-tin alloy overlay directly adjacent its perimeter which, in conjunction with the additional perforations, lowers the low current clearing level of the fuse.

8 Claims, 6 Drawing Figures

ELECTRICAL CURRENT LIMITING FUSE WITH BOUND SAND FILLER AND IMPROVED LOW CURRENT FAULT CLEARING

BACKGROUND OF THE INVENTION

The present invention relates generally to electrical fused and particularly to fuses of the current limiting type in which the sand filler is bound into a rigid matrix.

A current limiting fuse typically includes a tubular insulating casing closed at both ends by metal terminal caps. Connected to the terminal caps and passing through the interior of the casing is at least one fusible wire or ribbon element, usually of silver. The fusible elements may in some cases be wound around a supporting core which extends axially in the casing between the end caps. The space around the elements and core is filled with a tightly packed arc-quenching filler, usually quartz sand.

In certain fuses known as the "bound filler" type, the sand particles, are bonded together by, for instance, colloidal silica particles so that the filler is in the form of a rigid matrix. The rigid nature of the filler matrix makes the fuse more rugged and, among other things, improves the low current clearing characteristics of the fuse by increasing the burn back rate of the fusible element and by increasing the thermal conductivity of the filler sufficiently to permit a reduction of the physical size of a fuse for a given current rating. Such a fuse is described in detail in the U.S. Pat. No. 3,838,375 issued 24 Sept. 1974 to Frind et al. and assigned to the same assignee as are the rights to the present invention.

It is important that when the fuse clears at low current that the initial fusing of the element takes place at the central portion of the fuse, so that neither end of the element will burn all the way back to its terminal cap. Otherwise, arcing at the terminal cap can result in a failure mode for the fuse.

For fuses with ribbon elements having regularly spaced perforations therein to provide cross-sectional "necks" which melt first, it is common practice to place an overlay of a low fusing point solder near the center of the element to assure initial melting there. Then, as the element reaches an elevated temperature near the fusing temperature of the solder overlay, the solder alloys with the silver. The alloying of the silver increases the resistivity and hence heating of the element there. The overlay is generally placed adjacent a centrally located one of the perforations.

One problem with the bound sand fuses has been that the increased conductivity of heat through the rigid matrix as compared to an unbound filler permits a higher current to flow through the fuse without raising the temperature fo the ribbon and overlay sufficiently to initiate the alloying process at the desired current and time. Decreasing the size of the ribbon element to compensate for the higher current carrying capability of the ribbon in the rigid matrix would, however, change the currenttime characteristic of the fuse by reducing the time lag for all but the relatively high currents. This would offset one of the specific purposes of the solder overlay, which is to change the shape of the time-current characteristic curve by increasing the lag time for lower currents while leaving the short lag for high currents unaffected.

SUMMARY OF THE INVENTION

The novel fuse has a ribbon element with a plurality of reduced cross-section necks along its length. A central segment of the ribbon is provided with an adjacent lower fusing point overlay. Surrounding the element is a rigid matrix filler. The element is provided in addition with one or more additional reduced surface area necks in close proximity to the solder overlay.

The additional segments of reduced cross section increase the local resistance of the element and at the same time reduce there the heat dissipation to the filler sufficiently that the low current melting characteristic is brought to the desired value without at the same time significantly affecting the high current energy let-through characteristic.

DESCRIPTION OF THE PREFERRED EMBODIMENT

Figure 1:
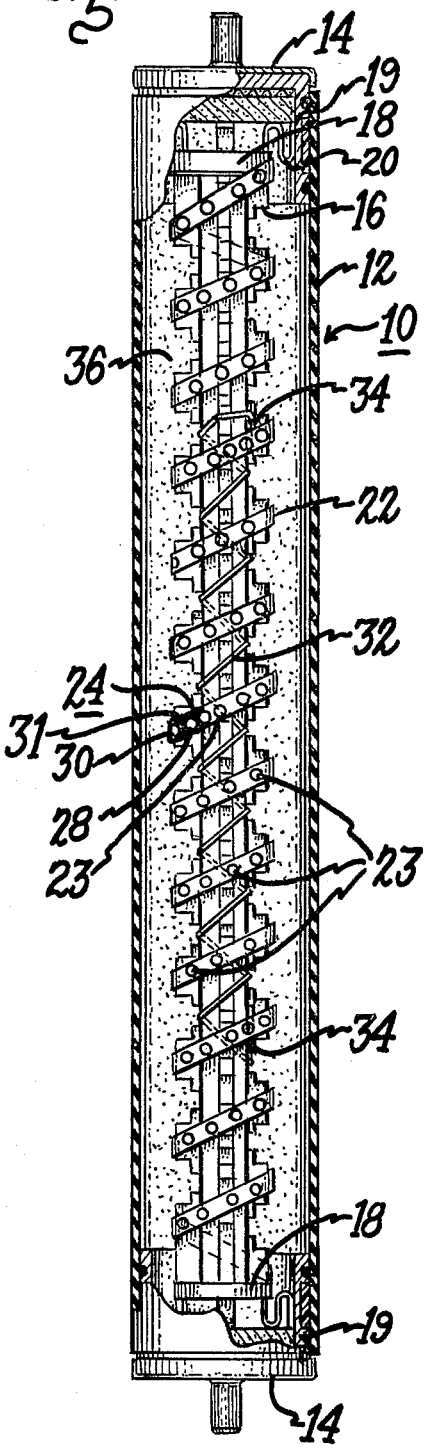
FIG. 1 is a partially exposed, sectioned side view of a current limiting fuse in accordance with a preferred embodiment of the invention.
Figure 2:
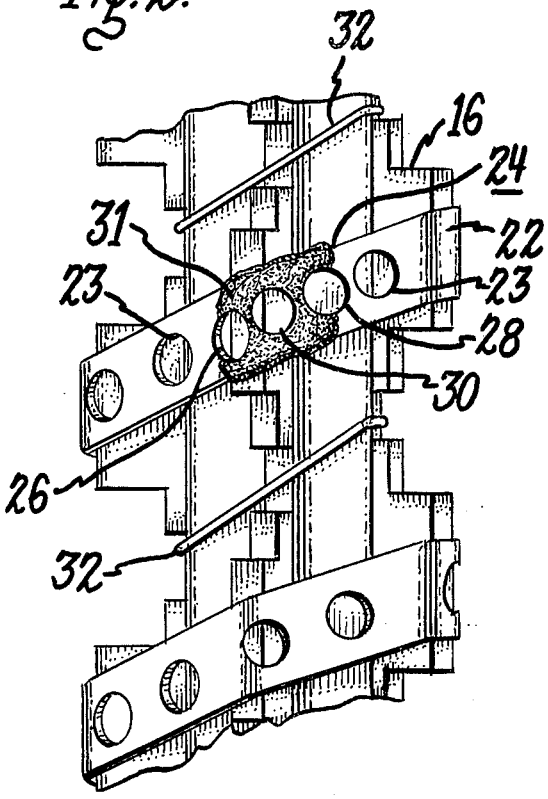
FIG. 2 is an exaggerated view of a fragment of the fuse of FIG. 1 showing certain features of the fusible element in greater detail.

A preferred embodiment of the invention is the general purpose fuse 10 shown in FIG. 1 of the drawings. The fuse 10 has an insulating tubular casing 12 of glass fibers and epoxy with an inside diameter of about 5cm (centimeters) and sealed at both ends by bronze terminal caps 14. Situated between the caps 14 and extending along the interior of the fuse 10 is a stepped gas producing support core 16 which is centered in the caps 14 by metal connector clips 18 having tabs 20 welded to the inside wall of a sleeve 19. A pure silver fusible ribbon element 22 is wound helically on the outermost steps of the core 16 along the axis of the fuse 10 and connected at its ends to the connector clips 18. The ribbon element 22 is 0.0125 cm thick, about 0.47cm wide, and provided at 1.27cm regualar intervals with round perforations 23 about 0.32cm in diameter for cross-section necks. A central segment 24 of the ribbon 22 shown in more detail in FIG. 2, has two additional perforations 26, 28 located midway between a central perforation 30 and the regular perforations 23 to either side for surface area necks. The surface on the outer side of the ribbon 22 between approximately the midpoints of the additional perforations 26, 28 is covered with a solder overlay 31 of about 60% lead and 40% tin, by weight.

Figure 3:
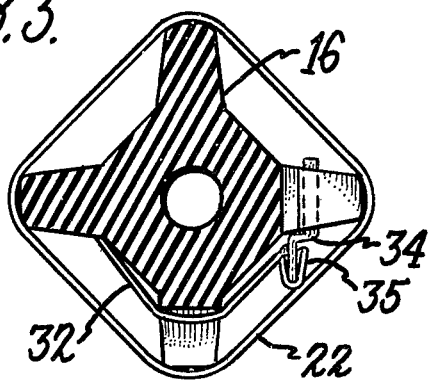
FIG. 3 is a top, sectioned view of an nner portion of the fuse of FIG. 1.
Figure 4:
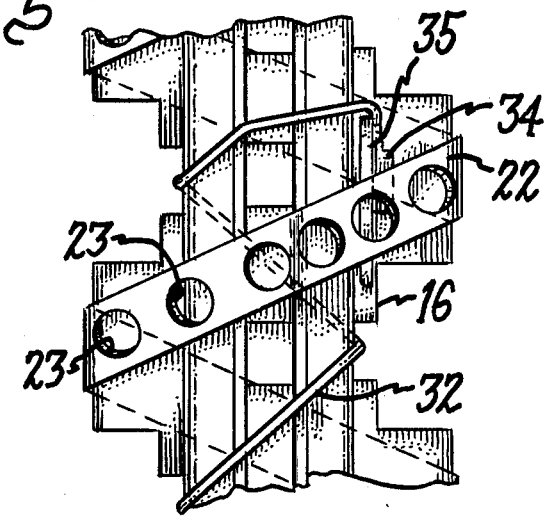
FIG. 4 is an exaggerated side view of a fragment of the inner portion of the fuse of FIG. 1.
Figure 5:
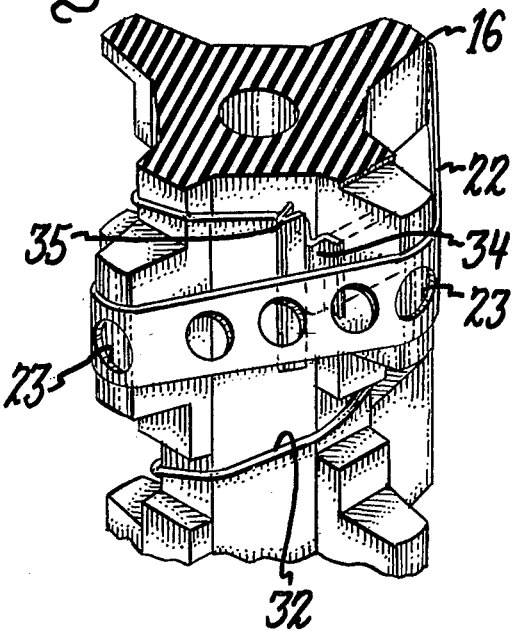
FIG. 5 is an elevational view of a fragment of the inner portion of the fuse of FIG. 1 and showing in more detail the structure of FIG. 3.

An auxiliary fusible silver wire element 32 about .025cm in diameter is wound helically about the innermost steps of the core 16 between two metal arcing clips 34, one of which is shown in more detail in FIGS. 3, 4 and 5. The clips 34 press outwardly on a portion of the ribbon 22 and are each located about midway between the central segment 24 of the ribbon 22 and one connector clip 18. Covering the surface of each arcing clip 34 and interposed between it and the ribbon is a piece of non-porous polyamide resin paper dielectric tape 35 about 0.005cm thick and having a dielectric strength of about 900 volts per mil (per 25.4 micrometers).

The remaining interior space of the fuse 10 around the ribbon 22, the wire 32 and the core 16 is filled with a tightly packed arc-quenching quartz sand filler 36 which is bound into a rigid matrix by colloidal silica particles.

Figure 6:
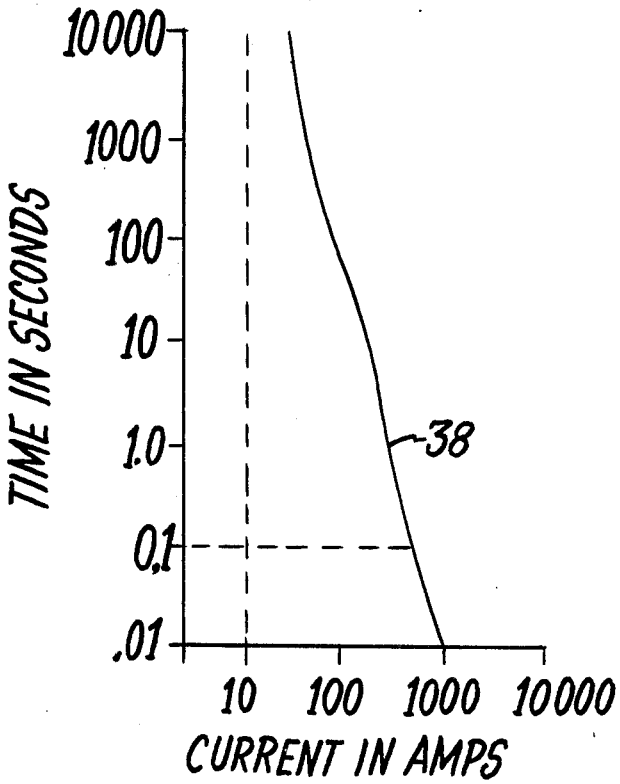
FIG. 6 is a graphical representation of certain currenttime characteristics of the fuse of FIG. 1.

The operating characteristics of the fuse 10 can be better understood by reference to the FIG. 6, which is a graphical representation of the relationship between the current through the fuse 10 and the time elapsing before the fuse 10 will operate. The logarithmic scale ordinate of the graph represents the time in seconds that the current passes through the fuse 10, while the logarithmic scale absicca represents the magnitude of the current in amperes. It can be seen from the characteristic curve 38 that at currents above 1000 amperes, the fuse 10 operates essentially instantaneously. The ribbon 22 melts at every cross-sectional neck 23 to result in a series of arcs which elongate as the ribbon 22 burns back, to eventually build up sufficient back-voltage for extinguishing the arcs and clearing the fault.

For low fault currents, those which require on the order of 1000 seconds or longer before the fuse 10 operates, the mode of operation is completely different. As the temperature of the solder overlay 31 increases to near its fusion point, the solder overlay begins to melt and to diffuse into the ribbon 22 to form an alloy having a greater resistance than the ribbon element 22. This causes the segment 24 to rapidly melt and initiate arcing. As the ribbon 22 burns back and the voltage across the arc is increased by the increased arch length, the voltage of the arc appears across the insulating tape 35 of the arcing clips 34 which are maintained at the same potential by the wire element 32. When the voltage across the tape 35 reaches a critical value, the tape 35 breaks down and arcing between the clips 34 and the ribbon 22 melts the ribbon 22 at the clips 34 to also establish arcs there to more rapidly limit the current.

The additional perforations 26, 28 have the effect of accelerating the alloying process of the ribbon 22. The rigid matrix filler 36 has a somewhat better thermal conductivity than a similar non-bound filler which is merely tightly packed into the housing. This increased thermal conductivity has the effect of moving the upper part of the curve 38 in the FIG. 6 to the right. The addition of the perforations 26, 28 however, reduces the heat transfer between the filler 36 and the ribbon 22 sufficiently to again shorten the time for operation of the fuse 10 and to bring the curve 38 back to its desired position. As the overall dimensions of the ribbon 22 remain essentially unchanged, the high current characteristics of the fuse 10 are preserved.

General Considerations

For a given fuse in accordance with the present invention, the number of additional perforations as well as their size may be readily determined by empirical methods well known to those of ordinary skill in the art of high voltage fuses. Where the filler is bound by a binder other than colloidal silica, or is a different filler entirely, the number of additional perforations may have to be increased or decreased. For the type of fuse of the preferred embodiment, it has been found that as many as four additional perforations, two to either side of the central perforation, and between that perforation and the next regular one, lead to even a greater shift in the curve 38 toward the ordinate. However, the degree of shifting is much less pronounced for perforations in excess of two than for the first two, and is relatively insignificant for additional perforations in excess of four.

For a fuse of the type described in the preferred embodiment, it has been found that the given relative dimensions of the ribbon and the perforations are particularly favorable for its functioning. The apertures have a diameter of abou two thirds the width of the ribbon element. Also, for the dimensions of the ribbon and perforations, it has been found that the weight per unit length of solder overlay material should preferably be about two and one-half times the weight per unit length of the ribbon in its unapertured portions.

In the case of a ribbon element, such as in the fuse 10 of the preferred embodiment, both cross-sectional necks and surface area necks may be conveniently provided by removing part of the ribbon locally, such as by punching holes or notches in the ribbon. However, it should be noted that in accordance with the present invention, the additional perforations in the central segment of the ribbon are provided not for reducing the cross section, as are the regular perforations, but rather for reducing the surface area, and thus the heat transfer to the filler. A similar effect for reducing the surface area could presumably be achieved by other means, such as by folding the ribbon to decrease the surface in contact with the filler or otherwise change the configuration without changing the total cross section. On the other hand, the cross-section of the element can also be reduced by locally reducing the thickness. Thus it is seen that while the functions of cross-sectional and surface area necks are in the case of the fuse 10 of the preferred embodiment provided by perforations, where an element of a configuration other than a ribbon is used as the main element, the present invention may be utilized by other configurations for the necks.

I claim:

1. An electrical current limiting fuse of the type having an insulating tubular casing sealed at the ends by metal terminal caps, at least one fusible element connected between the terminal caps and extending along the interior of the casing, and a bound matrix of sand packed inside the casing and surrounding the element, wherein the improvement comprises that;

a segment of said element approximately centrally located between said caps comprises one or more reduced surface area necks which are in addition to any regularly spaced reduced cross-section necks of said element, and an overlay of metal having a lower fusing temperature than said element on the surface of said segment.

2. The fuse claimed in claim 1 and wherein said element is a ribbon.

3. The fuse claimed in claim 2 and wherein said ribbon comprises cross-sectional necks in the form of regularly spaced perforations along its length.

4. The fuse claimed in claim 3 and wherein said surface area necks are in the form of additional perforations in said segment.

5. The fuse claimed in claim 4 and wherein said overlay is a lead-tin solder and said element is essentially pure silver.

6. The fuse claimed in claim 5 and wherein said solder has a composition by weight of about 60% lead and 40% tin.

7. The fuse claimed in claim 6 and wherein said apertures have a diameter of about two-thirds the width of said ribbon element.

8. The fuse claimed in claim 7 and wherein said alloy is located on both sides of said aperture and is in an amount about two and one-half times the weight per unit length of said ribbon in the unapertured portions.

* * * * *